US006059220A

United States Patent [19]

Lassiter

[11] Patent Number: 6,059,220

[45] Date of Patent: May 9, 2000

[54] WIRE RACK WITH PULLER ROLLER

[76] Inventor: Daniel T. Lassiter, 9918 Nicholas Rd., Windham, Ohio 44288

[21] Appl. No.: 09/019,960

[22] Filed: Feb. 6, 1998

[51] Int. Cl.[7] ..... B65H 16/02

[52] U.S. Cl. ..... 242/557; 242/129; 242/134; 242/595; 242/599.2; 280/47.19

[58] Field of Search ..... 242/129, 129.5, 242/134, 557, 594.1, 594.2, 595, 595.1; 280/47.19; 211/85.5

[56] References Cited

U.S. PATENT DOCUMENTS

| | | | |
|---|---|---|---|
| 340,265 | 4/1886 | West . | |
| 991,827 | 5/1911 | Capers . | |
| 1,009,827 | 11/1911 | Capers . | |
| 1,902,611 | 3/1933 | Blackman et al. | 242/595.1 |
| 1,929,160 | 10/1933 | Bellocchio . | |
| 1,946,848 | 2/1934 | Goldsmith | 242/594.1 |
| 2,525,755 | 10/1950 | Aldrich | 242/595.1 |
| 2,660,381 | 11/1953 | Friedl et al. . | |
| 2,949,248 | 8/1960 | Flynn et al. . | |
| 2,957,638 | 10/1960 | Schiller et al. . | |
| 2,958,478 | 11/1960 | Petersen et al. | 242/595 |
| 3,006,570 | 10/1961 | Boser | 242/595.1 |
| 3,134,555 | 5/1964 | Baker . | |
| 3,267,827 | 8/1966 | Fairbanks | 242/595.1 |
| 3,375,991 | 4/1968 | Conforti et al. . | |
| 3,603,519 | 9/1971 | Brown et al. | 242/594.1 |
| 3,685,760 | 8/1972 | Fedor . | |
| 3,695,532 | 10/1972 | Lindstaedt | 242/595 |
| 3,743,205 | 7/1973 | Misrach . | |
| 3,856,230 | 12/1974 | Zimmer . | |
| 3,900,063 | 8/1975 | Roller | 242/595.1 |
| 3,934,854 | 1/1976 | Goode | 242/557 |
| 4,176,801 | 12/1979 | Doulgas . | |
| 4,391,422 | 7/1983 | McDonald | 242/557 |
| 4,537,106 | 8/1985 | Rider . | |
| 4,651,938 | 3/1987 | Memminger et al. | 242/595.1 |
| 4,838,497 | 6/1989 | Kramer et al. . | |
| 4,978,085 | 12/1990 | Letourneau . | |
| 5,308,012 | 5/1994 | Fuller . | |
| 5,316,232 | 5/1994 | Lambert, Jr. . | |
| 5,509,671 | 4/1996 | Campbell | 242/594.6 |
| 5,634,610 | 6/1997 | Walsh | 242/594.2 |
| 5,687,928 | 11/1997 | Lassiter . | |

FOREIGN PATENT DOCUMENTS

| | | | |
|---|---|---|---|
| 2258230 | 8/1975 | France | 242/129.5 |

*Primary Examiner*—Donald P. Walsh
*Attorney, Agent, or Firm*—Sand & Sebolt

[57] ABSTRACT

A wire dispensing rack for holding a wire spool such that wire may be dispensed from the spool includes a first frame assembly. At least first and second support rollers are carried by the first frame assembly. The support rollers are adapted to seat different sized spools holding wire to be dispensed. A puller roller is carried by the first frame assembly below said first and second support rollers. A wire spool is placed on the support rollers and the wire to be dispensed is passed under the puller roller. When the wire to be dispensed is pulled, the wire engages the puller roller creating a downward force on the spool pulling it into the support rollers. The spool is thus retained on the wire rack through the force of dispensing wire.

19 Claims, 7 Drawing Sheets

WIRE RACK WITH PULLER ROLLER

BACKGROUND OF THE INVENTION

TECHNICAL FIELD

The invention relates to a rack for holding wire dispensing spools. More particularly, the invention relates to a rack for holding wire dispensing spools which uses the pulling force that dispenses the wire to hold the dispensing spool on the wire rack during dispensing. Specifically, the invention relates to a wire rack having spaced support rollers which seat a dispensing spool and a puller roller disposed below the support rollers wherein the wire coming off of the spool passes between the support rollers and under the puller roller to create a downward force on the spool keeping it seated on the support rollers during dispensing.

BACKGROUND INFORMATION

Typical wire dispensing racks include a center axle that runs through the center of wire dispensing spools. The dispensing spools rotates on the axle as wire is pulled and dispensed from the spools. One problem with wire dispensing racks having center axles is that the spools often continue to rotate after the desired length of wire is dispensed causing extra wire to leave the spool. The extra wire often overrides the sides of the spool and becomes entangled or wrapped around the center axle causing it to jam requiring the user to spend time untangling the wire.

Wires of various gauges often must be dispensed during commercial electrical installations. Many conventional wire dispensing racks are capable of holding only a single dispensing spool. If using such racks, the electrician must purchase and use multiple racks in order to properly and quickly complete the wire installation. In addition to the added cost, these multiple racks and wires of various gauges as well as other installation tools and materials must be transported between the electrician's work truck or a storage area to the work site increasing the amount of time the electrician must spend to prepare for and clean up from a job.

Another problem with axle-mounted wire racks is that if more than one spool is mounted on a single axle, the electrician must at least partially remove the axle from the rack to change an empty spool and in some instances other spools must be completely removed to access the empty spool. This respooling process is cumbersome, unproductive, and time consuming.

Although some wire dispensing racks exist that do not support the wire dispensing spools on a center axle, these racks do not provide a simple configuration that maintains the wire dispensing spool in contact with the rack when the wire is pulled from the dispensing spool. If the wire rack does not have a retaining mechanism, a wire spool may be easily pulled off of the rack when wire is pulled from the spool. A cumbersome retaining mechanism is not, however, desired in the art because it may consume more time to install the wire spools in the retaining mechanism than would be wasted by pulling the spools off of the rack. It is desired in the art to provide a wire dispensing rack onto which the wire spools may be placed that is configured to retain the wire spools while the wire is being dispensed.

Another problem with existing wire dispensing racks that do not utilize a center axle is that wire spools of different sizes are supported by common rollers. The difference in diameters of the spools causes them to rotate at different rotational speeds when wire is pulled from both spools at the same speed. The variation in rotational speeds creates a situation where one of the spools may easily fall off of the wire rack. It is thus desired in the art to provide a wire dispensing rack that is capable of holding multiple spools of various diameters.

Therefore, the need exists in the art for an improved wire rack that may easily receive different sized spools without using a center axle while having a configuration that creates a force that holds the spool on the rack during dispensing.

SUMMARY OF THE INVENTION

Objectives of the present invention include providing an improved rack for wire dispensing spools which is capable of holding a plurality of various sized spools.

Another objective of the invention is to provide a wire rack that does not employ a center axle to hold the spools on the rack.

Yet another objective of the invention is to provide a wire rack for spools which allows the spools to rotate independently of one another.

Still another objective of the invention is to provide a wire rack for spools which only uses a pair of spaced rollers to seat the spools such that a wire spool may be easily placed onto the rack or removed from the rack.

A further objective of the invention is to provide a wire rack for spools that uses a puller roller over which wire is dispensed to create a force that holds the spool on the wire rack.

Still a further objective of the invention is to provide a wire rack for spools which allows the spools to be added and removed from the rack without interfering with the use of other spools.

Yet a further objective of the invention is to provide a wire rack for spools which is expandable to hold different numbers of spools.

Another objective of the invention is to provide a wire rack for spools that includes side rollers that prevent the spools from moving out of position or jamming on the wire rack.

A further objective of the invention is to provide a wire rack that includes a stabilizer bar that prevents the wire rack from turning over during use.

Another objective of the invention is to provide a wire rack for spools that has wheels so that it can be easily moved.

A further objective of the invention is to provide a wire rack for spools that is configured so that the rollers of the rack may be easily removed and replaced.

Another objective of the present invention is to provide a wire rack for spools that is of simple construction, which achieves the stated objectives in a simple, effective, and inexpensive manner, in which solves the problems and which satisfies the needs existing in the art.

These and other objectives and advantages are obtained by the improved wire rack of the present invention, the general nature of which may be stated as including a first frame assembly; first and second support rollers carried by the first frame assembly, the support rollers adapted to seat a spool holding wire; and a first puller member carried by the first frame assembly below the first and second support rollers.

BRIEF DESCRIPTION OF THE DRAWINGS

The preferred embodiments of the invention, illustrative of the best modes in which Applicant contemplated applying the principles, are set forth in the following description and are shown in the drawings and are particularly and distinctly pointed out and set forth in the appended claims.

Similar numbers refer to similar parts throughout the drawings.

DESCRIPTION OF THE PREFERRED EMBODIMENTS

Figure 1:
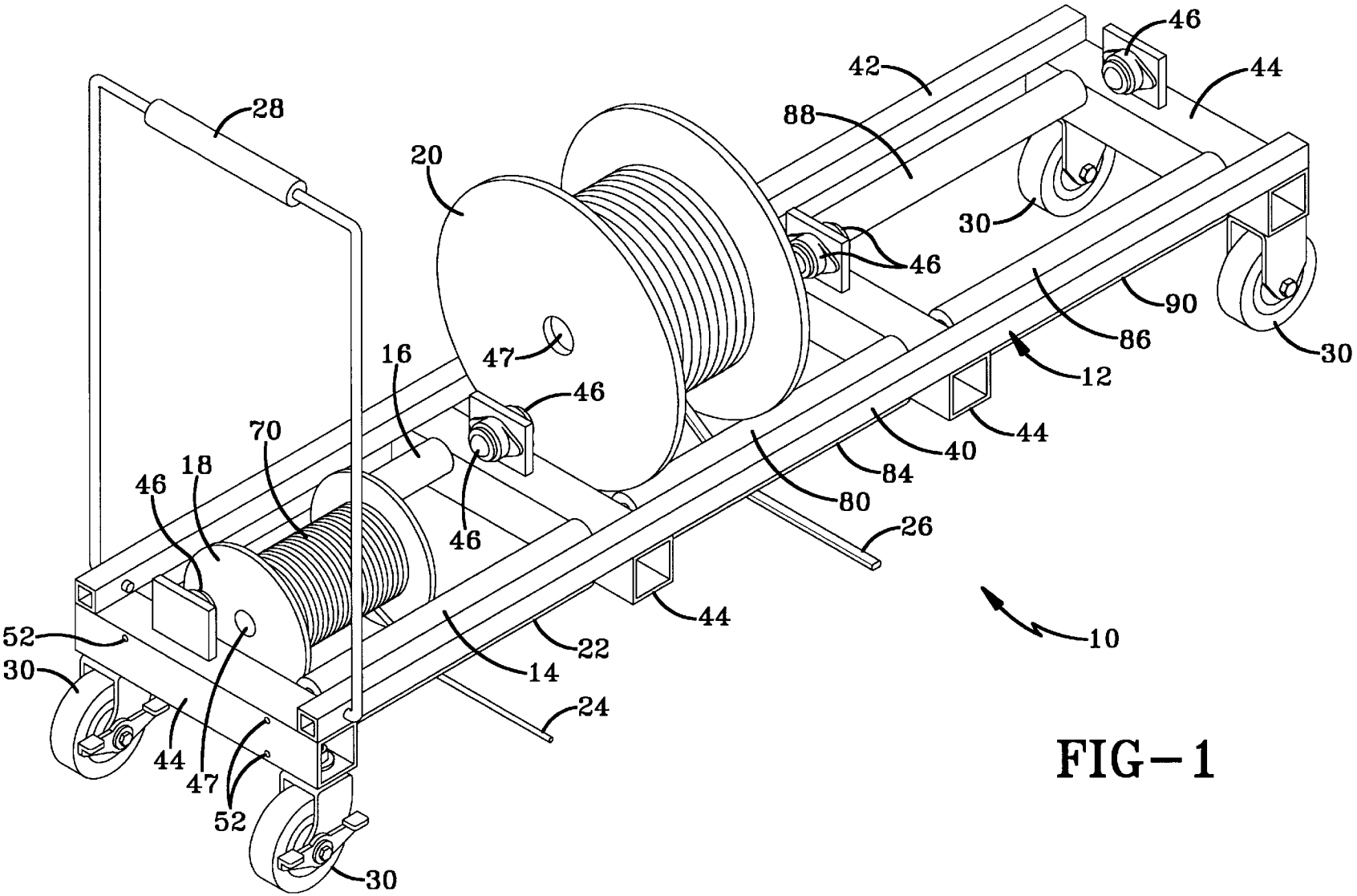
FIG. 1 is a perspective view of the wire rack of the present invention showing two different sized spools being held thereon.
Figure 2:
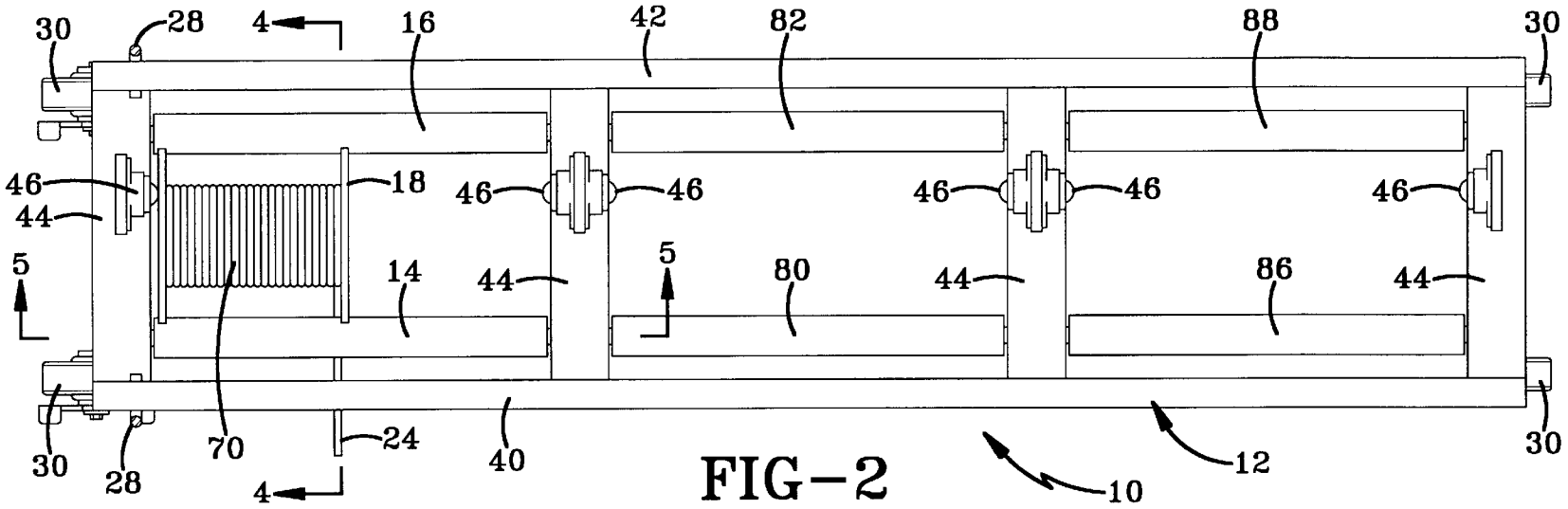
FIG. 2 is a top plan view of the wire rack.
Figure 3:
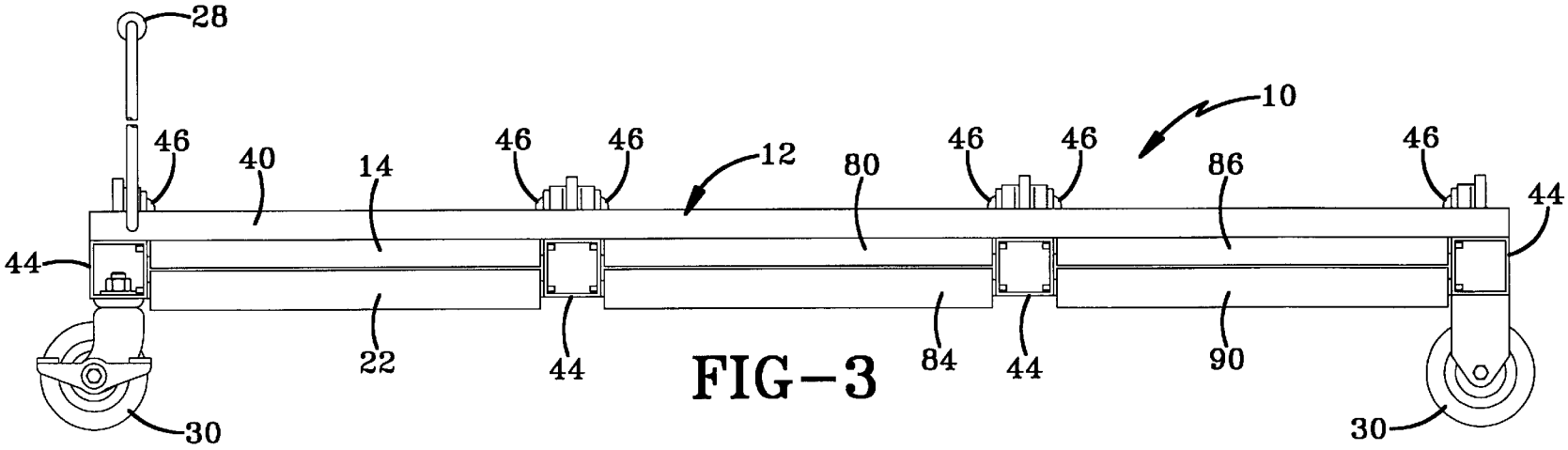
FIG. 3 is a front elevational view of the wire rack depicted in FIG. 2.

The wire rack of the present invention is shown in FIG. 1 and is indicated generally by the numeral 10. Wire rack 10 generally includes a first frame assembly 12 that supports at least first 14 and second 16 support rollers. Support rollers 14 and 16 are disposed close enough together to seat a spool 18 for 22 gauge wire while being spaced far enough apart to seat a spool 20 for 10 gauge wire. Rollers 14 and 16 are spaced such that they seat six to eighteen inch spools. Wire rack 10 further includes a first puller roller 22 that is disposed below first 14 and second 16 support rollers. Although it is generally desirable to use a roller similar to support rollers 14 and 16 as puller roller 22, a puller member in the form of a bar or other rigid member disposed below support rollers 14 and 16 would also function to create the downward force required by the present invention. Roller 22 is preferred because of the lack of friction between the wire being pulled and roller 22. Wire 24 or 26 is pulled under puller member or roller 22 during dispensing to create a downward force on spool 18 or 20.

A handle 28 is pivotally connected to first frame assembly 12 to allow a person to move wire rack 10 or to lift one end of wire rack 10. A plurality of wheels 30 are connected to wire rack 10 to facilitate movement. Wheels 30 may be lockable to provide stability to wire rack 10. Wheels 30 may also be removed when wire rack 10 is installed in a location where it is not intended to be moved such as the back of a van or truck. Wire rack 10 is configured to fit within the back of a truck or van because wire rack 10 holds spools 18 and 20 such that their axes of rotation are parallel to the longitudinal length of wire rack 10.

First frame assembly 12 includes a front 40 spaced from a rear frame member 42 by at least two side frame members 44. In embodiments of the invention having multiple pairs of first and second support rollers, additional side frame members 44 to carry the support rollers and puller rollers are also provided in first frame assembly 12. Front and rear frame members 40 and 42 may be fabricated from one inch square stock while side frame members 44 may be fabricated from two inch square stock. In other embodiments of the invention, frame members 40,42, and 44 may be fabricated from differently shaped materials. Frame members 40, 42, and 44 may be preferably welded together but may also be connected with suitable connectors such as bolts, screws, rivets, and the like.

Wire rack 10 further includes a side roller 46 carried by first frame assembly 12 adjacent each pair of support rollers 14 and 16. Side rollers 46 engage spools 18 or 20 seated on rollers 14 and 16 to laterally position spools 18 or 20. Side rollers 46 are non-centrally disposed on side frame members 44 so that they do not engage center hole 47 of spools 18 or 20. Side rollers 46 rotatably engage the sides of spools 18 or 20 such that essentially no friction is created by the engagement that would interfere with the dispensing of wire 24 or 26. Side rollers 46 are configured such that spool 18 or 20 may not become disengaged with support rollers 14 and 16. This prevents spools 18 or 20 from becoming jammed between support rollers 14 and 16 and side frame members 44. In other embodiments of the present invention, additional side rollers 46 may be provided but it has been found that one side roller 46 disposed on each side of support roller set 14 and 16 is sufficient for the purposes of the present invention.

Rollers 14, 16, and 22 are supported between side frame members 44 through the engagement of axles 48 with holes 50 in side frame members 44. Axles 48 are spring biased such that they may be pressed into rollers 14, 16, or 22 so that they may be installed and removed from between side frame members 44. Side frame members 44 disposed on either end of first frame assembly 12 are provided with access holes 52 that allow a rod or pin to be pushed through side frame member 44 to engage axle 48 to depress it into roller 14, 16, or 22. Rollers 14, 16, or 22 may thus be removed from first frame assembly 12 in this manner. It may be understood that once one set of rollers 14, 16 or one roller 22 is removed, the remaining adjacent rollers may be removed by using holes 50 as access holes.

Figure 4:
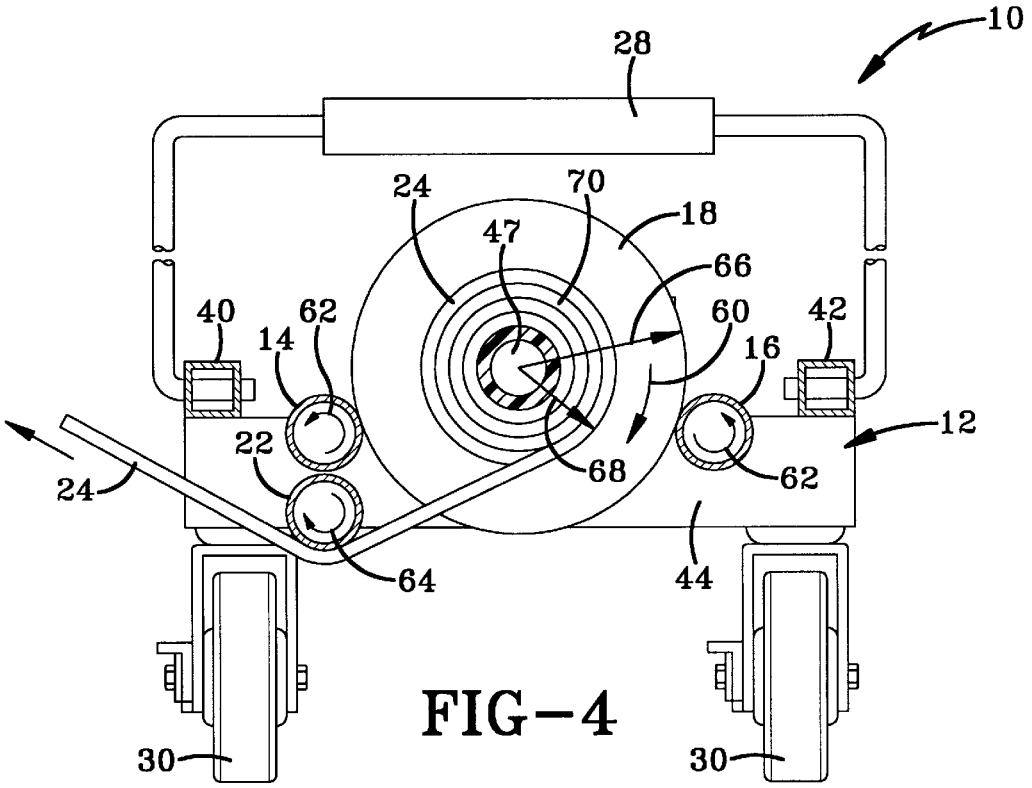
FIG. 4 is a sectional view taken along line 4—4 of FIG. 2.
Figure 5:
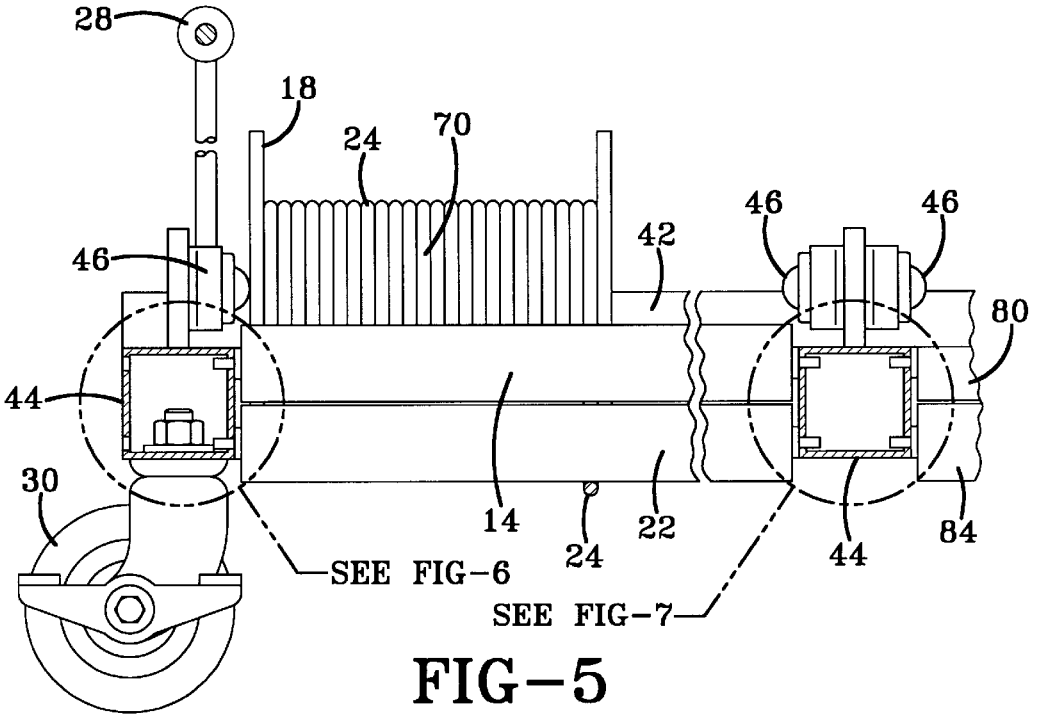
FIG. 5 is a sectional view taken along line 5—5 of FIG. 2.
Figure 7:
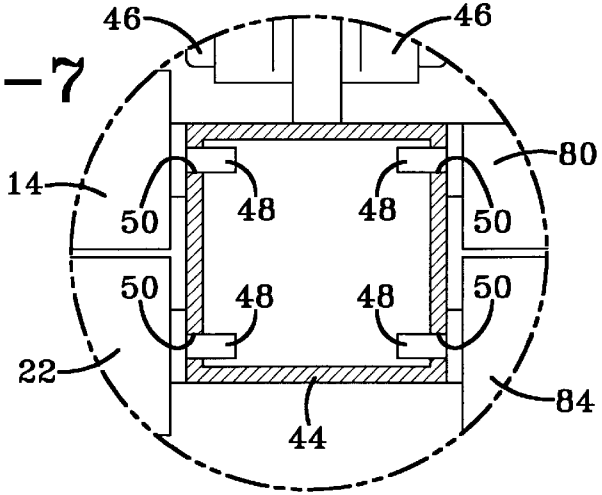
FIG. 7 is an enlarged view of a portion of the wire rack circled in FIG. 5.
Figure 6:
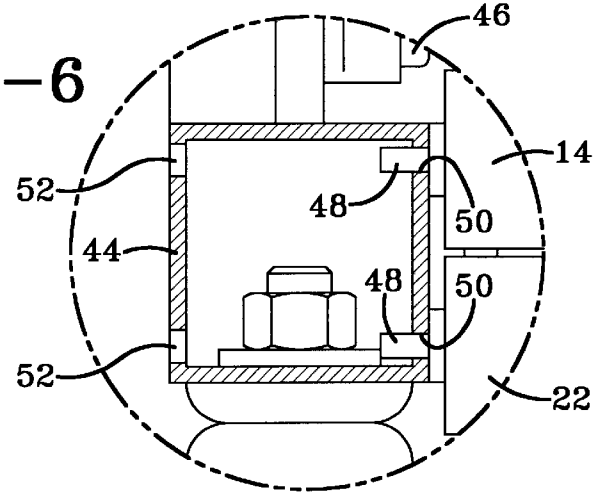
FIG. 6 is an enlarged view of the portion of the wire rack circled in FIG. 5.

Wire spool 18 may be installed on wire rack 10 by simply seating spool 18 onto support rollers 14 and 16. No other installation steps are required because support rollers 14 and 16 are spaced close enough to each other to prevent spool 18 or 20 from falling between them. Wire 24 may be dispensed from spool 18 by pulling it under puller roller 22 and upwardly and outwardly from wire rack 10. As may be seen in FIG. 4, the dispensing of wire 24 causes spool 18 to rotate clockwise as indicated by numeral 60. Spool 18 rotates on support rollers 14 and 16 causing both support rollers 14 and 16 to rotate counterclockwise as indicated by numeral 62. The engagement of wire 24 with puller roller 22 causes puller roller 22 to rotate clockwise as indicated by numeral 64. Wire 24 may not be pulled under support roller 14 because roller 14 would then be forced in opposing directions creating friction between wire 24 and roller 14 or roller 14 and spool 18. The friction would cause the dispensing motion to be nonuniform and may cause spool 18 to jump off of support rollers 14 and 16. Wire 24 may not be pulled under support roller 16 even though such pulling would cause roller 16 to rotate in the same direction as the rotation caused by spool 18 because the rotations are at different speeds caused by the difference of radius 66 of spool 18 and radius 68 of wire roll 70. The difference in rotational speeds would create undesirable friction between wire 24 and support roller 16.

The position of puller roller 22 below support rollers 14 and 16 creates a downward force on spool 18. The downward force pulls spool 18 into engagement with support rollers 14 and 16 so that it may not fall off of wire rack 10 during dispensing. In fact, as wire 24 is pulled harder, the downward force increases to hold spool 18 more securely on wire rack 10. It may be understood that this downward force may be created by puller roller 22 even if puller roller 22 is not positioned directly below one of support rollers 14 or 16. Puller roller 22 must be positioned below support rollers 14 and 16 in a location as to not engage spool 18 or spool 20 or spools of other sizes that may be supported by support rollers 14 and 16.

Spool 18 may be inverted such that wire 24 is pulled from the front of spool 18 and down under puller roller 22. In this situation, spool 18 rotates counterclockwise while support rollers 14 and 16 rotate clockwise. The downward force on spool 18 is maintained and the objectives of the present invention are met by this configuration. The position of spool 18 on rack 10 is thus not critical to the function of the present invention.

Spools 18 and 20 may be removed from wire rack 10 simply by lifting spool 18 or 20 away from support rollers 14 and 16 where spool 18 or 20 is seated. No other action is required to move spool 18 or 20 from wire rack such as disengaging center axles as in the prior art.

Although wire rack 10 may be used with a single set of support rollers 14 and 16, it is often desirable to provide additional sets of support rollers to increase the storage capacity of wire rack 10. For instance, in the embodiment of the invention depicted in FIGS. 1 through 7, third 80 and fourth 82 support rollers are provided between side frame members 44. Third and fourth support rollers 80 and 82 are supported in the same manner as first and second support rollers 14 and 16. A second puller roller 84 is also provided below third and fourth support rollers 80 and 82. Although rollers 80 and 82 are spaced apart the same distance as rollers 14 and 16 in the embodiment of the invention depicted in the drawings, support rollers 80 and 82 may also be spaced apart a different distance to seat different sized spools. Fifth 86 and sixth 88 support rollers are also provided adjacent third and fourth 80 and 82 support rollers. A third puller roller 90 is also provided. As such, wire rack 10 includes three sets of support rollers and three puller rollers such that it may hold at least three spools independently. Support rollers 14 and 16, 80 and 82, or 86 and 88 may also be long enough to support two spools each.

In some applications, a stabilizer bar or pair of stabilizer bars 92 may be added to wire rack 10 to provide added stability to wire rack 10. Stabilizer bars 92 may be desirable when heavy gauge wire is used with wire rack 10. Each stabilizer bar 92 extends substantially perpendicular to the rotational axis of either spool 18 or 20. Each stabilizer bar 92 is non-rotatably connected to first frame assembly 12. In the embodiment of the invention depicted in FIG. 9, each stabilizer bar 92 is non-rotatably connected to first frame assembly 12 through the engagement of a square peg 94 slidably received in front frame member 40 which is hollow. When stabilizer bars 92 are used, it may be desirable to configure stabilizer bars 92 in a manner that lifts wheels 30 off of the ground so that wire rack 10 is solely supported on stabilizer bars 92. Although the drawings only depict a pair of bars 92 extending from rack 10, two additional bars 92 or feet may be added to rack 10 on the opposite side of rack 10.

Figure 9:
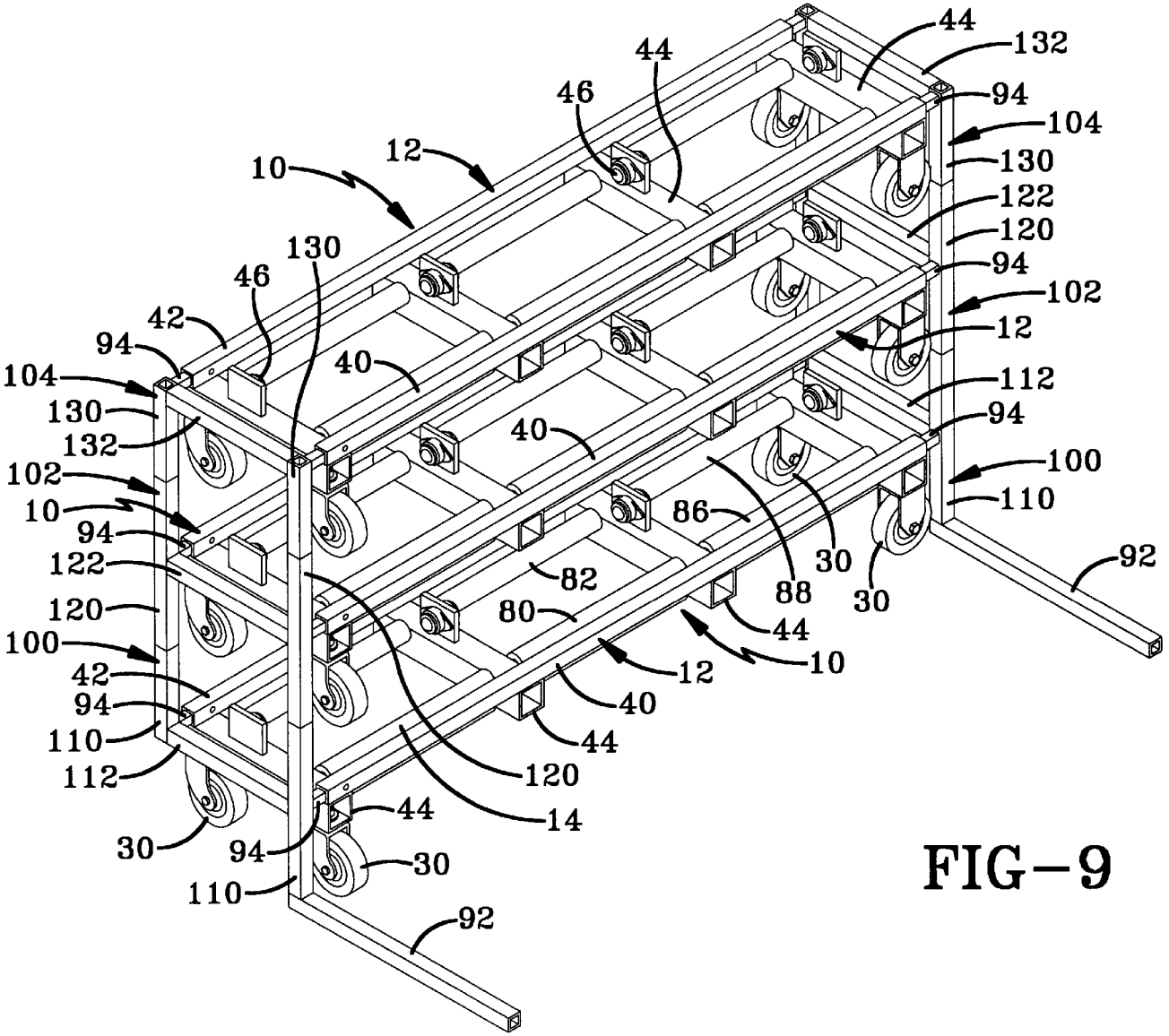
FIG. 9 is a perspective view of multiple wire racks of the present invention stacked together.

In some wiring applications, many different types and sizes of wire are required. In these situations it is desirable to provide a wire rack 10 that is expandable to hold multiple spools. In FIG. 9, multiple wire racks 10 are stacked vertically on vertical extensions 100, 102, and 104. As can be seen in FIG. 9, vertical extension 100 includes a pair of vertical members 110 connected by a horizontal member 112. Vertical extension 100 connects to first frame member 12 by a pair of square pegs 94 that are received in front frame member 40 and rear frame member 42. Vertical extension 102 also includes a pair of vertical members 120 connected by a horizontal member 122. Vertical extension 102 also has square pegs 94 that are received in frame assembly 12 of wire rack 10 on the second level. Third vertical extension 104 also includes a pair of vertical members 130 connected by a horizontal member 132. Third vertical extension 104 also includes a pair of square pegs 94 that allow it to be non-rotatably connected to frame assembly 12 on upper wire rack 10. Vertical extensions 100, 102, and 104 may be connected to each other any of various connectors known in the art. In the preferred version of the present invention, vertical extensions 100, 102, and 104 are fit together with a series of peg and receptacle connections in vertical members 110, 120, and 130. These connections allow vertical extensions 100, 102, and 104 to be quickly and easily assembled and disassembled.

Figure 8:
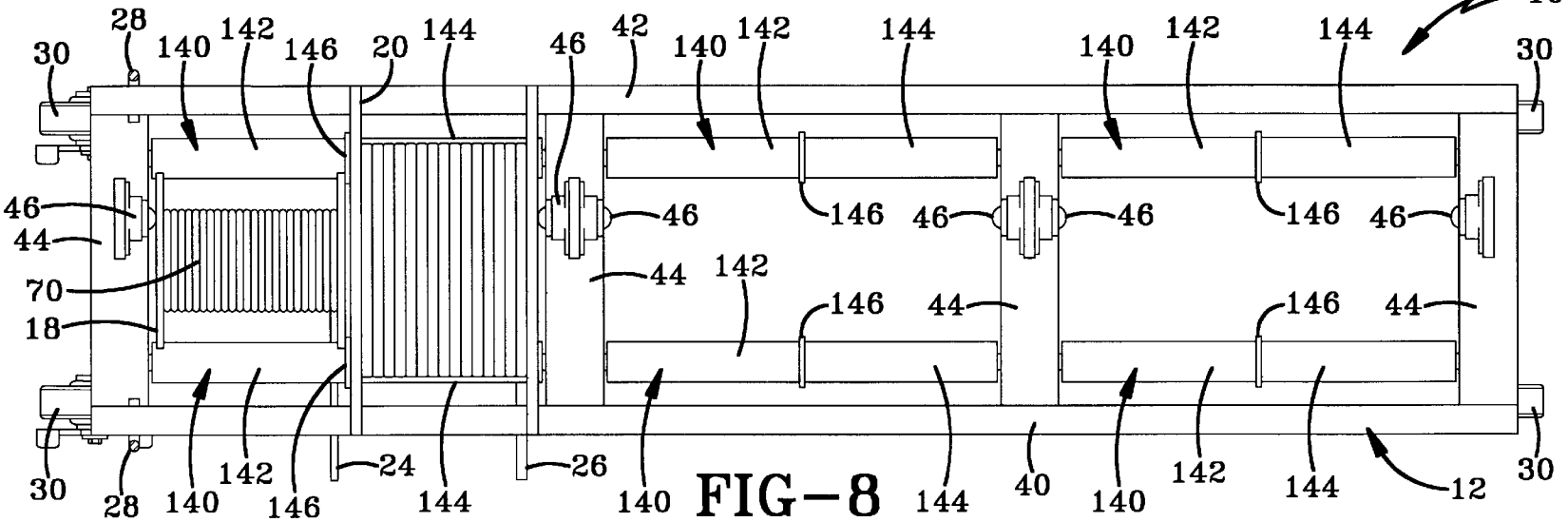
FIG. 8 is a top plan view of an alternative embodiment of the wire rack of the present invention.

An alternative embodiment of wire rack 10 is depicted in FIG. 8. FIG. 8 depicts the use of support rollers 140 having independently rotatable outer sleeves 142 and 144. Sleeves 142 and 144 are separated by washers 146 that have diameters larger than sleeves 142 and 144 to prevent adjacent spools from engaging each other and creating undesirable friction. Sleeves 142 and 144 allow adjacent spools 18 and 20 to rotate independently of each other without undesirable friction.

Figure 11:
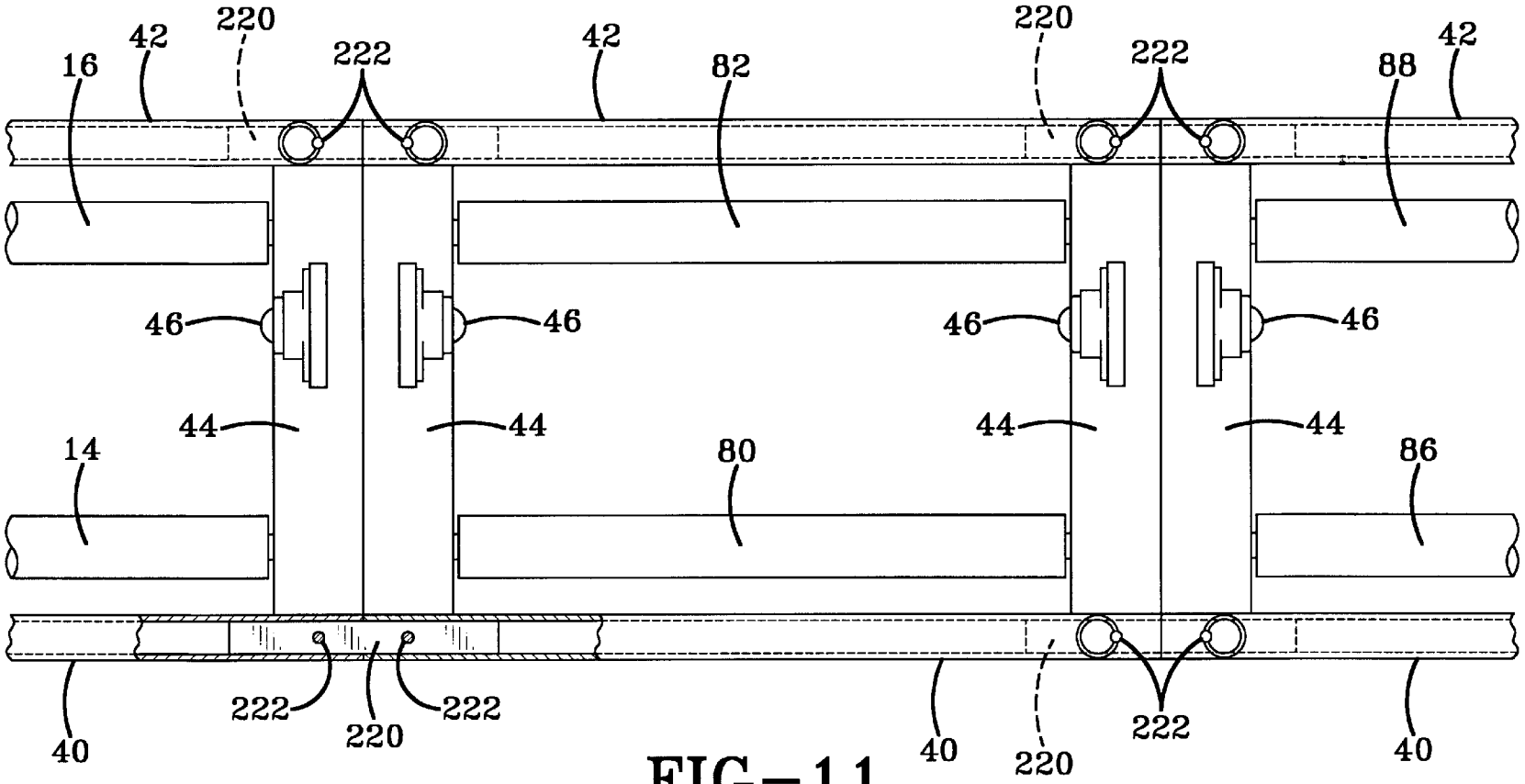
FIG. 11 is a view of an alternative embodiment of the wire rack of the present invention.

Another alternative embodiment of the wire rack of the present invention is depicted in FIG. 11. In this embodiment, each set of support rollers 14 and 16, 80 and 82, and 86 and 88 is supported on its own independent frame assembly that includes a front frame member 40, a rear frame member 42, and a pair of side frame members 44. Support rollers 14, 16, 80, 82, 86, and 88 are supported between side frame members 44 in the same manner as described above. Pullers rollers 22, 84, and 90 are also disposed below their respective support roller sets as described above.

Each frame assembly that supports a set of support rollers is independently attachable to one another with pins 220 that are non-rotatably received between frame members 40 and 42. In the embodiment of the invention depicted in the drawing, pins 220 are square in cross section and fits snugly inside frame members 40 and 42 to provide a non-rotatable connection between the members. When connected, side frame members 44 are disposed side to side. Pins 220 are secured in place with two pins 222 that pass through frame members 40 and 42, through pins 220 and back out the bottom surface of frame members 40 and 42. Pins 220 and 222 allow multiple sets of support rollers to be assembled together in a side by side manner. Although only three sets of support rollers are depicted in the drawing, it may be understood that more or less sets may be assembled in this manner to provide more room for wire spools.

Figure 10:
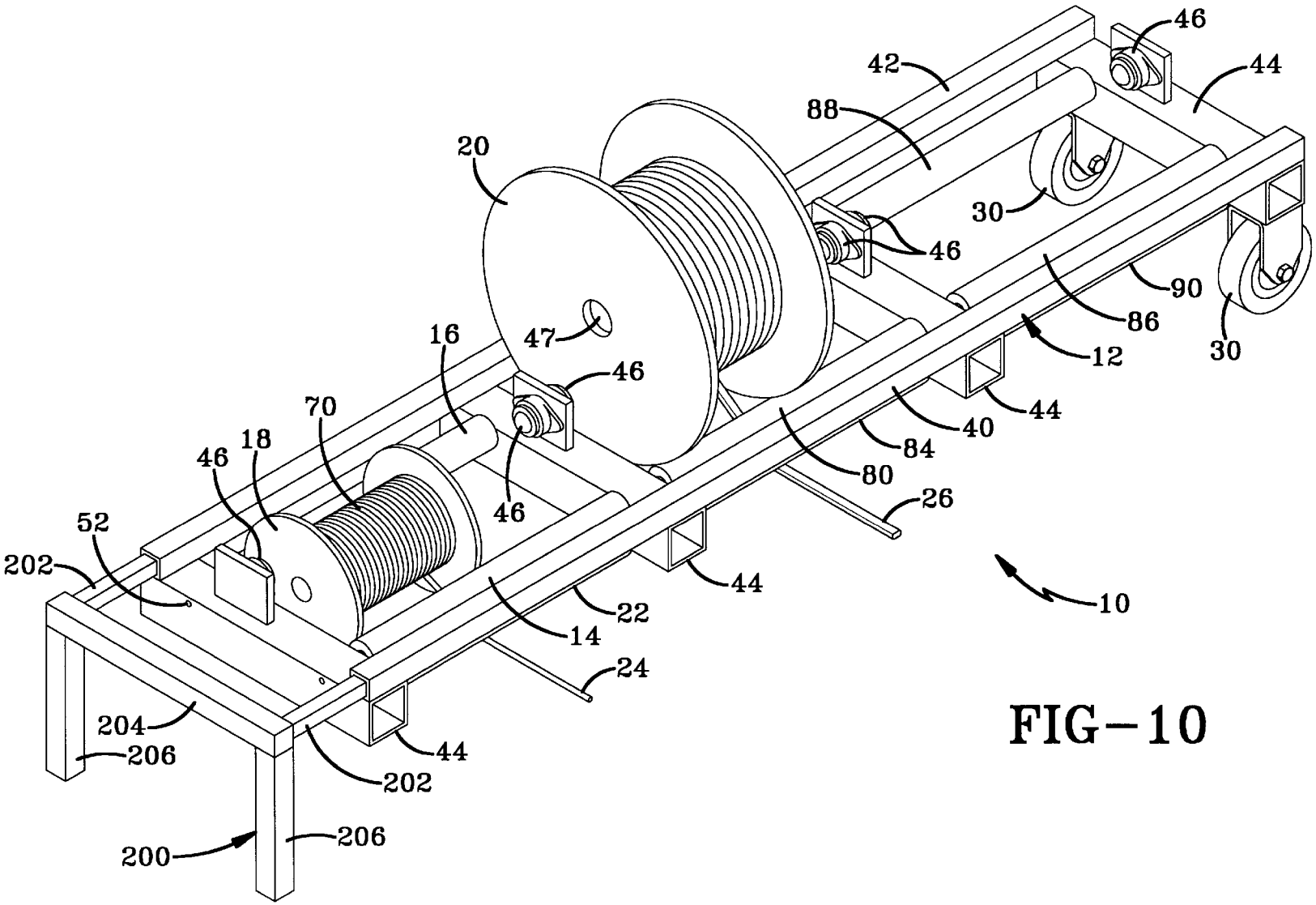
FIG. 10 is a perspective view of a wire rack with an alternative handle.

FIG. 10 depicts the use of an alternative handle 200 attached to wire rack 10. Handle 200 includes a pair of pegs 202 that are non-rotatingly received in frame members 40 and 42. Pegs 202 extend outwardly from side frame member 44 a distance sufficient that a person can grasp a handle bar 204 without injuring a hand on member 44. A pair of legs 206 are further provided to support the end of wire rack 10 with requiring wheels. Handle 200 allows wire rack 10 to be used like a dolly such that it may be wheeled about from place to place but is stable when set down.

Accordingly, the improved wire rack apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the wire rack is constructed and used, the characteristics of the construction, and the advantageous new and useful results obtained; the new and useful structures, devices, elements, arrangements, parts, and combinations are set forth in the appended claims.

I claim:

1. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire; and a first puller member carried by said first frame assembly below said first and second support rollers whereby wire may be passed between said first and second support rollers and under said puller member when the wire is pulled from the spool thus forcing the spool against the first and second support rollers;

said first puller member carried by said first frame assembly in a position spaced from said first and second support rollers; said first puller member being retained below said first and second support rollers as the wire is passed thereunder.

2. A wire dispensing rack according to claim 1 wherein said first and second support rollers are laterally spaced.

3. A wire dispensing rack according to claim 2 wherein said first and second support rollers are substantially parallel.

4. A wire dispensing rack according to claim 1 wherein each of said support rollers includes first and second independently rotatable roller sleeves.

5. A wire dispensing rack according to claim 1 further comprising third and fourth support rollers carried by said first frame assembly and a second puller member carried by said first frame assembly below said third and fourth support rollers.

6. A wire dispensing rack according to claim 5 further comprising fifth and sixth support rollers carried by said first frame assembly and a third puller member carried by said first frame assembly below said fifth and sixth support rollers.

7. A wire dispensing rack according to claim 6 wherein each of said support rollers includes first and second independently rotatable roller sleeves.

8. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire; and a first puller member carried by said first frame assembly below said first and second support rollers whereby wire may be passed between said first and second support rollers and under said puller member when the wire is pulled from the spool thus forcing the spool against said first and second support rollers;

said first puller member being a roller, said roller being spaced from said first and second support rollers and being substantially parallel to said first and second support rollers.

9. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire;

a first puller member carried by said first frame assembly and retained below said first and second support rollers as the wire is passed thereunder; and a stabilizer bar removably connectable to said first frame assembly, said stabilizer bar extending from said first frame assembly when connected to said first frame assembly; said stabilizer bar extending substantially parallel to a reference plane including both first and second support rollers.

10. A wire dispensing rack according to claim 9 wherein each of said support rollers has an axis of rotation, said stabilizer bar extending substantially perpendicular to said axes of rotation of said support rollers.

11. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire;

a first puller member carried by said first frame assembly below said first and second support rollers; and vertical extensions connectable to said first frame assembly and a second frame assembly carried by said vertical extensions above said first frame assembly.

12. A wire dispensing rack according to claim 11 wherein said second frame assembly includes at least one set of support rollers carried by said second frame assembly and a puller member carried by said second frame assembly below each set of support rollers.

13. A wire dispensing rack according to claim 11 further comprising at least one stabilizer bar extending from at least one of said vertical extensions.

14. A wire dispensing rack according to claim 11 further comprising a third frame assembly carried by said vertical extensions above said second frame assembly, said third frame assembly carrying at least one set of support rollers and a puller member below each set of support rollers.

15. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire;

a first puller member carried by said first frame assembly below said first and second support rollers; and a side roller carried by said first frame assembly on each side of said first and second support rollers.

16. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire;

a first puller member carried by said first frame assembly below said first and second support rollers; and another frame assembly, a pair of support rollers carried by said another frame assembly, a puller member carried by said another frame assembly below said pair of support rollers, and a pair of pins connecting said first frame assembly to said another frame assembly.

17. A wire dispensing rack for holding a wire spool such that wire may be dispensed from the spool, the wire dispensing rack comprising:

a first frame assembly;

first and second support rollers carried by said first frame assembly, said support rollers adapted to seat a spool holding wire;

a first puller member carried by said first frame assembly below said first and second support rollers; and a handle having a handle bar extending between a pair of pegs; said handle further having a pair of legs extending downwardly from said handle bar; said pegs being non-rotatingly received in said first frame assembly.

18. In combination, a wire rack carrying a first spool holding a length of wire, said combination comprising:

a first frame assembly;

first and second support rollers carried by said first frame assembly;

a first puller member carried by said frame below said support rollers;

said first spool rotatably seated on said first and second support rollers;

said wire extending between said first and second support rollers and under said puller member; said wire engaging said puller member when said wire is pulled from said first spool to force said first spool downwardly against said support rollers to increase the stability of said first spool while said wire is pulled from said spool;

said first puller member being retained by said frame and prevented from moving upwardly into contact with said first spool.

19. The combination according to claim 18 wherein each of said support rollers includes first and second independently rotatable sleeve portions, said first spool carried by said first sleeve portions; and further comprising a second spool carried by said second sleeve portions.

* * * * *